US011365548B1

(12) United States Patent
Meeks

(10) Patent No.: US 11,365,548 B1
(45) Date of Patent: Jun. 21, 2022

(54) LOWER EDGE FINISH FOR DRYWALL WITH INSTALLATION AIDS

(71) Applicants: Robert B. Jordan, IV, Mt. Gilead, NC (US); Eddie Alexander Meeks, Greensboro, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 0 days.

(21) Appl. No.: 16/994,877

(22) Filed: Aug. 17, 2020

(51) Int. Cl.
*E04F 19/06* (2006.01)
*E04F 21/00* (2006.01)
*E04F 19/04* (2006.01)

(52) U.S. Cl.
CPC ..... *E04F 19/06* (2013.01); *E04F 19/049* (2013.01); *E04F 21/00* (2013.01); *E04F 2019/0413* (2013.01)

(58) Field of Classification Search
CPC ..... B05B 12/20; B05B 12/22; B05B 12/24; B05B 12/26; B05B 12/265; B05B 12/29; B05B 12/32; B05B 12/34; E04F 19/049; E04F 19/06; E04F 21/00; E04F 2019/0413
See application file for complete search history.

(56) References Cited

U.S. PATENT DOCUMENTS 2,029,549 A * 2/1936 Winterich ..... E04F 13/12 52/288.1
2,203,119 A * 6/1940 Wollaeger ..... E04F 19/0468 52/718.02
2,290,472 A * 7/1942 Hendrick ..... B05B 12/28 118/505
2,298,251 A * 10/1942 Burson ..... E04F 13/045 52/27
2,726,633 A * 12/1955 Miron ..... B05B 12/28 118/504
2,946,099 A * 7/1960 Lawlor ..... E04F 19/061 52/718.02
3,039,433 A * 6/1962 Kormuth ..... B05B 12/28 118/505
3,422,798 A * 1/1969 Pine ..... E04F 21/0069 118/504
3,429,296 A * 2/1969 Legere ..... B05B 12/28 118/504
4,258,654 A * 3/1981 Ivankovich ..... B05B 12/28 118/504

(Continued)

*Primary Examiner* — James M Ference
(74) *Attorney, Agent, or Firm* — MacCord Mason PLLC

(57) ABSTRACT

A lower edge finish for a drywall includes a channel with first and second sidewalls, the channel sized to receive a drywall sheet. A base underneath the channel can support drywall sheet above a floor and has a recess below the channel that extends from the first sidewall toward the second sidewall and has a curved furrow upward toward the channel. A paint guard includes a sheet and an edge that is thicker than the sheet. The edge has a lip that is of a shape complementary to the furrow, so the lip can be passed into the recess and the lip becomes lodged in the furrow to retain the edge between the floor and the base, and the sheet extends away from the stud wall to protect the floor from drippings from the drywall sheet.

18 Claims, 6 Drawing Sheets

(56) References Cited

U.S. PATENT DOCUMENTS 4,325,323 A * 4/1982 Rioux ..... B05C 21/00 118/504
4,622,791 A * 11/1986 Cook ..... E04B 2/825 52/241
4,846,100 A * 7/1989 Montoya ..... B44D 3/12 118/504
5,046,749 A * 9/1991 Owens ..... B44D 3/126 280/79.5
5,063,720 A * 11/1991 Bifano ..... E04F 21/04 52/309.1
D324,575 S * 3/1992 Davis ..... D25/119
5,230,738 A * 7/1993 Wheeler ..... E04G 21/30 118/504
5,970,671 A * 10/1999 Bifano ..... E04B 1/765 428/603
6,119,429 A * 9/2000 Bifano ..... E04B 1/765 52/101
6,293,064 B1 * 9/2001 Larson ..... E04B 1/762 52/209
6,298,609 B1 * 10/2001 Bifano ..... E04B 1/765 52/101
6,314,695 B1 * 11/2001 Belleau ..... E04F 13/06 427/294
6,374,559 B1 * 4/2002 Rutherford ..... E04B 1/6815 52/393
6,470,638 B1 * 10/2002 Larson ..... E04B 1/765 52/254
8,740,457 B2 * 6/2014 MacDonald ..... B65D 33/04 383/4
8,915,044 B2 * 12/2014 Kline ..... E04F 21/185 52/716.8
8,955,277 B1 * 2/2015 Joye ..... F16M 11/00 52/302.1
9,366,040 B2 * 6/2016 Singh ..... E04B 1/64
9,428,922 B2 * 8/2016 Silk ..... E04F 19/061
9,649,652 B2 * 5/2017 Hildre ..... B05B 12/28
9,663,944 B1 * 5/2017 Lam ..... E04B 2/723
10,100,530 B1 * 10/2018 Clark ..... E04B 1/7038
10,196,812 B1 * 2/2019 Duffy ..... E04F 13/06
10,870,995 B1 * 12/2020 Meeks ..... E04F 19/049
2005/0183361 A1 * 8/2005 Frezza ..... E02D 27/00 52/293.3
2006/0107607 A1 * 5/2006 Dillon ..... E04F 19/04 52/211
2007/0163191 A1 * 7/2007 Berry ..... E04B 2/7457 52/281
2009/0064631 A1 * 3/2009 Frezza ..... E02D 27/00 52/745.09
2010/0325969 A1 * 12/2010 Hourihan ..... A47K 3/008 52/35
2012/0005967 A1 * 1/2012 Hourihan ..... A47K 3/008 52/35
2012/0255249 A1 * 10/2012 Singh ..... E04F 19/061 52/302.1
2013/0126694 A1 * 5/2013 Kline ..... E04F 19/061 248/346.5
2015/0308125 A1 * 10/2015 Helms ..... E04F 13/0866 52/309.9
2016/0208484 A1 * 7/2016 Pilz ..... E04B 2/7457
2016/0262576 A1 * 9/2016 Kratzmann ..... E04F 19/061
2016/0362898 A1 * 12/2016 Silk ..... E04F 19/049
2017/0254091 A1 * 9/2017 Friel ..... E04B 1/765
2017/0306618 A1 * 10/2017 Braun ..... E04F 19/064
2017/0328057 A1 * 11/2017 Pilz ..... E04B 1/946
2018/0051470 A1 * 2/2018 Smith ..... E04F 13/045
2018/0171646 A1 * 6/2018 Stahl ..... E04F 21/0053
2019/0194954 A1 * 6/2019 Baltz, Jr ..... G02B 5/00

* cited by examiner

LOWER EDGE FINISH FOR DRYWALL WITH INSTALLATION AIDS

BACKGROUND OF THE INVENTION

Framed walls are typically comprised of a stud, post or column for structural support and a surface mounted onto the structural support. Plaster and stucco are examples of higher end materials used as surfaces to create a finished wall. However, drywall sheets are commonly used instead due to their lower cost. One caveat to installing drywall sheets is that the drywall sheet must remain raised over the floor surface to prevent it from absorbing moisture and forming mold.

Typically, drywall sheets are installed using drywall lifts to keep the drywall sheets above ground until they are fastened onto a structural support. Since that method of installation of drywall sheets leaves a gap between the bottom edge of the sheet and the floor, baseboards are commonly installed to conceal the spacing, which further adds to installation costs. When using metal framing, another option for installing a drywall sheet may comprise installing a stud wall onto a sill plate that extends under the studs and contains a shelf for supporting a drywall sheet, as disclosed in US Publication No. 2005/0183361. However, in that structure the plates must be installed before adding the studs.

Accordingly, there remains a need for a lower edge finish to support a drywall sheet that can be used even after the installation of a stud wall, while at the same time, concealing the gap between the drywall and floor without the need for installing a separate baseboard.

SUMMARY OF THE INVENTION

The present invention fulfills one or more of these needs in the art by providing a lower edge finish to support a drywall above a surface to prevent the drywall from molding while remaining easy to install and use. In a preferred embodiment, the lower edge finish for a drywall comprises a channel formed from a first sidewall and a second sidewall for receiving a drywall sheet, and a base underneath the channel for supporting the drywall sheet above a surface. The second sidewall and the base are adapted to be placed flush against a stud wall and the lower edge finish is free of extension from the second sidewall toward the stud wall.

The base may be continuous along a length of the channel. The height of the base may determine the height at which the drywall may be raised above a surface (typically the floor or subfloor). For example, the base may have a height of about ½ inches. In one embodiment, the base does not extend toward the stud wall past the second sidewall. For example, the base may be flush with the first sidewall and second sidewall.

The second sidewall may be taller than the first sidewall. The first sidewall may be spaced a distance apart from the second sidewall such that the first sidewall is almost flush with an outermost face of a drywall sheet when it is inserted into the channel.

In one embodiment, the base may be comprised of extruded plastic. For instance, the first sidewall and the second sidewall may be comprised of sheet metal. In a particular embodiment, the first sidewall is perforated. In another embodiment, the base and sidewalls are comprised of extruded plastic.

The invention may also be considered as a wall assembly including a stud wall forming a support frame, a lower edge finish installed on the bottom of a face of the stud wall, and a drywall sheet. The lower edge finish is mounted along a floor on which the stud wall rests, completely surface mounted on the stud wall. The lower edge finish comprises a channel formed from a first sidewall and a second sidewall that are spaced apart to enable receipt of the drywall sheet, and a base underneath the channel for supporting the drywall sheet above the floor. The drywall sheet has a lower edge in the channel with its weight supported by the base of the lower edge finish secured to the stud wall. The second sidewall and the base are placed flush against the stud wall. The wall assembly may further include a plate installed on the bottom of the stud wall. The base does not extend toward the stud wall past the second sidewall.

The present invention can also be considered a method for installing drywall. In one embodiment, the method comprises installing a stud wall on a floor, fastening a channel formed from a first sidewall and a second sidewall to the stud wall with the channel having a base so a bottom of the channel is spaced above the floor, and inserting a drywall sheet within the channel. The method may also further include a step of painting the drywall sheet and first sidewall to create a uniform appearance. Tape and/or drywall mud (also called joint compound) may be applied to the top edge of the first sidewall to smooth its appearance.

The step of installing a stud wall may comprise installing the studs of the stud wall onto a plate. The step of fastening the channel to the stud wall may comprise positioning the second sidewall to abut the stud wall and fastening the second sidewall to the stud wall.

The invention can also be considered a lower edge finish for a drywall that includes a channel formed from a first sidewall defining a front plane and a second sidewall defining a back plane that is parallel to the front plane, with the channel sized to receive a drywall sheet. A base underneath the channel is used to support the drywall sheet above a floor. The base has a recess below the channel that extends from the front plane toward the second plane and has a furrow upward toward the channel between the front and back planes. The second sidewall and the base are adapted to be surface mounted at the floor on a stud wall. A paint guard that has a sheet and an edge is included. The edge has a lip that is of a shape to fit in the furrow, so the lip can be passed into the recess and become lodged in the furrow to retain the edge between the floor and the base. So placed, the sheet extends away from the stud wall to protect the floor from drippings from painting the drywall sheet.

The first sidewall may be perforated metal. The base has a front and the first sidewall may extend upward from the base slightly recessed from the front of the base. A paper sheet may extend upward from the base to at least partially cover the first sidewall.

The lip and the furrow may have complementary curved shapes. The base may be continuous along a length of the channel. The edge of the paint guard may be thicker than the sheet of the paint guard.

The invention can also be considered as a method for installing drywall including installing a stud wall onto a floor and fastening a channel with a base that has a drywall paper front to the stud wall at the floor. This is followed by inserting a lower edge of a drywall sheet into the channel so the drywall paper front partially covers the drywall sheet, and applying drywall mud to the drywall sheet, the drywall paper front, and the channel to form a smooth wall surface, including covering the drywall paper front with drywall mud.

The method may also include installing a paint guard to the base to protect the floor from drippings (such as paint drippings) from the drywall sheet. Installing a paint guard may include inserting an edge of the paint guard into a recess in the base.

The invention can also be considered as a method of installing drywall including installing a stud wall onto a floor, fastening a channel that has a base to the stud wall at the floor, inserting a lower edge of a drywall sheet into the channel so the drywall paper front partially covers the drywall sheet, and installing a paint guard to the base to protect the floor from drippings from the drywall sheet by inserting an edge of the paint guard into a recess in the base to retain the edge at the base.

The invention can also be considered as a lower edge finish for a drywall that can cooperate with a paint guard. The lower edge finish includes a channel formed from a first sidewall defining a front plane and a second sidewall defining a back plane that is parallel to the front plane, the channel sized to receive a drywall sheet, and a base underneath the channel for supporting a drywall sheet above a floor, the base having a recess below the channel that extends from the front plane toward the second plane and that has a furrow upward toward the channel between the front and back planes, the furrow having a shape to cooperate with a paint guard edge.

The invention can also be considered as a paint guard that can cooperate with a lower edge finish for drywall. The paint guard includes a sheet and an edge, the sheet and edge being impervious to paint, the edge having a lip that is of a shape that cooperates with the furrow in a recess of a lower edge finish for drywall so the lip can be passed into the recess and the lip becomes lodged in the furrow to retain the edge of the paint guard between the floor and the base, and the sheet extends away from the stud wall to protect the floor from drippings from the drywall sheet.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
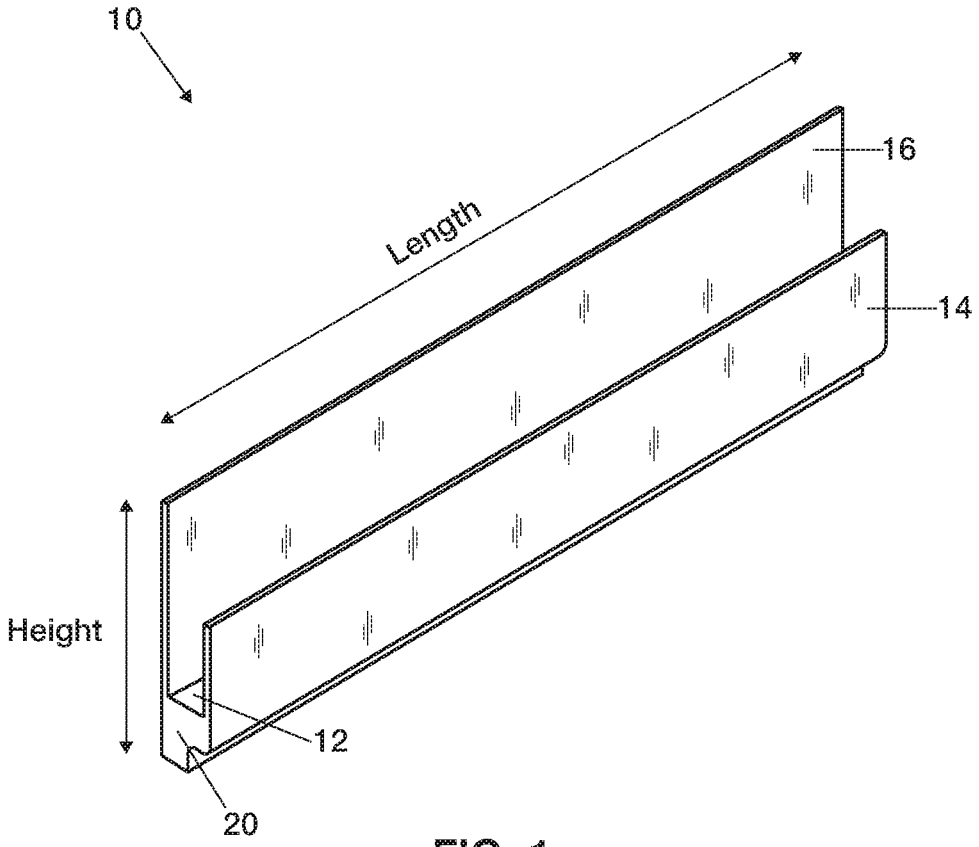
FIG. 1 is an overhead perspective view of a lower edge finish for a drywall constructed according to one embodiment.

FIG. 1 shows a lower edge finish 10 for a drywall made in accordance with features of the current invention. The lower edge finish 10 comprises a channel 12 formed from a first sidewall 14 and a second sidewall 16. The first sidewall 14 and second sidewall 16 are spaced a distance apart to accommodate a bottom edge of a drywall sheet within the channel 12. Preferably, the channel 12 permits a snug fit of the bottom edge of the drywall sheet. The lower edge finish 10 includes a base 20 below the channel 12 for supporting a drywall sheet inserted within the channel.

Sidewalls 14 and 16 span a length of the channel 12, either the entire length of the channel or a substantial portion of it. Similarly, the base 20 spans at least a portion of the length of the channel. One or more bases 20 may be included underneath the channel 12 for support. Preferably, the base 20 extends along a substantial portion of the channel 12 to provide a stable platform for a drywall sheet installed within the channel 12.

The first sidewall 14 is preferably at a height to help retain a lower edge of a drywall sheet within the channel 12 at a substantially upright position as the upper parts of the drywall sheet are secured to the stud wall in conventional fashion. The lower edge of the drywall sheet may need no additional nails or screws to mount to the stud wall, since it is held in place by the lower edge finish 10. The second sidewall 16 is preferably at a height so that it may be fastened onto a stud wall. In the embodiment shown, the second sidewall 16 has a height greater than the first sidewall 14. The base has a height of about ½ inches or higher to prevent a drywall sheet in the channel 12 from coming into contact with a floor surface.

Figure 2:
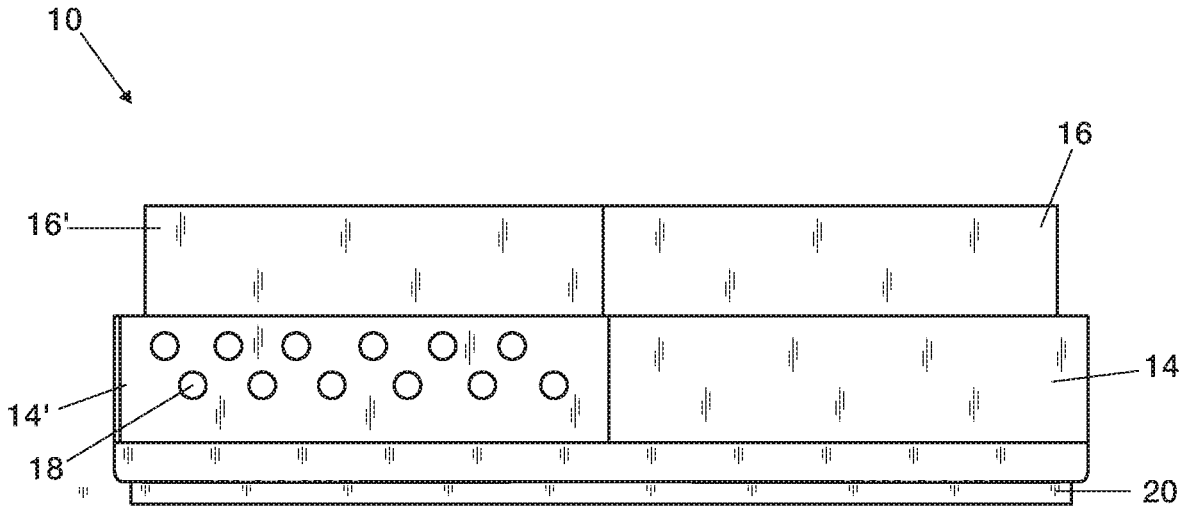
FIG. 2 is a front perspective view of two embodiments of a lower edge finish.

FIG. 2 depicts two examples of a lower edge finish 10. In both examples, the base 20 is comprised of an extruded plastic. On the left side, the sidewalls 14' and 16' are each comprised of sheet metal. On the right side is an example wherein the sidewalls 14 and 16 are comprised of an extruded plastic.

In the sheet metal embodiment shown in FIG. 2, the first sidewall 14' may be perforated so that drywall mud, when smeared onto the first sidewall, will be able to ooze into the holes and attach itself to the face of a drywall sheet. This creates a more solid bond of the mud between the face of a drywall sheet and the face of the first sidewall 14'. If the first sidewall 14' does not include perforations, the mud may only able to bond to the first sidewall, which may cause cracking of the mud at the top edge of the first sidewall 14' over time.

Figure 3:
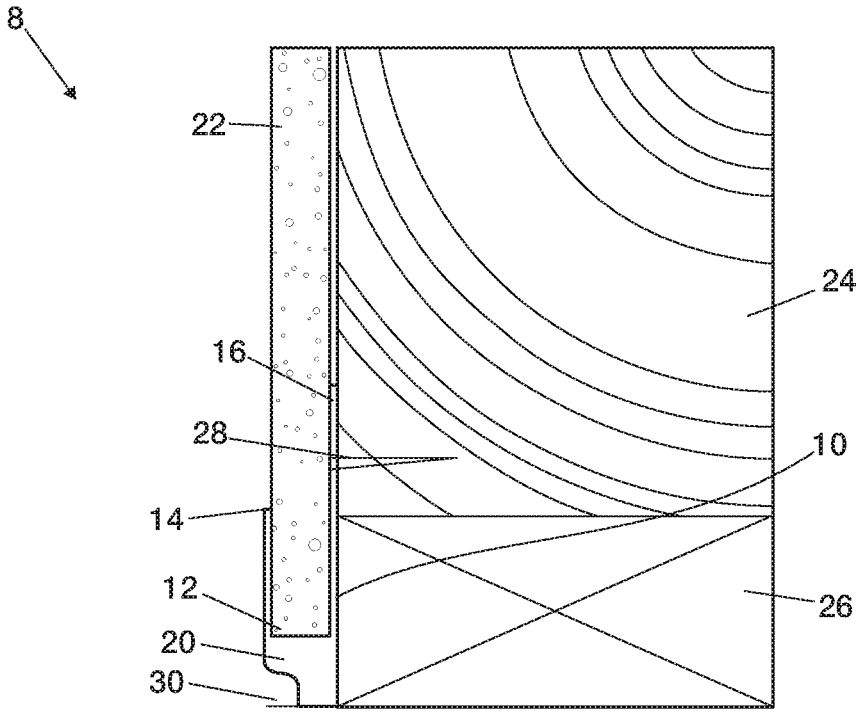
FIG. 3 is a side sectional view of a wall assembly mounted to a stud wall and with a drywall sheet in place with a lower edge finish constructed according to one embodiment.

One example of a wall assembly 8 that includes a lower edge finish 10 is shown in FIG. 3. Studs 24 of a stud wall are installed onto a plate 26 to provide a structural frame for supporting a wall. FIG. 3 shows the studs and plate made of wood, but metal can also be used. The lower edge finish 10 is placed on the floor surface 30 adjacent to the stud wall and plate 26 and positioned such that the second sidewall is surface mounted on the studs and plate of the stud wall. The lower edge finish 10 is secured onto a stud 24 via a fastener 28 such as a nail or screw that passes through a hole (preformed or formed by the fastener) in the second sidewall 16. A drywall sheet 22 is inserted into the channel 12, wherein the exposed face of the drywall sheet 22 is adjacent to the first sidewall 14 and the other face of the drywall sheet is adjacent to the second sidewall 16 and stud wall 24.

The base 20 does not extend under or into the studs 24. Instead, the base 20 and second sidewall 16 are surface mounted on the studs 24 and plate 26. While the example provided shows the base 20 substantially flush with both the first sidewall 14 and the second sidewall 16, other examples of the base 20 may extend away from the plate 26 past the first sidewall 14. The base 20 acts as a raised support for the drywall sheet 22 without leaving a gap under the assembly below the floor, obviating the need of a baseboard.

Figure 4:
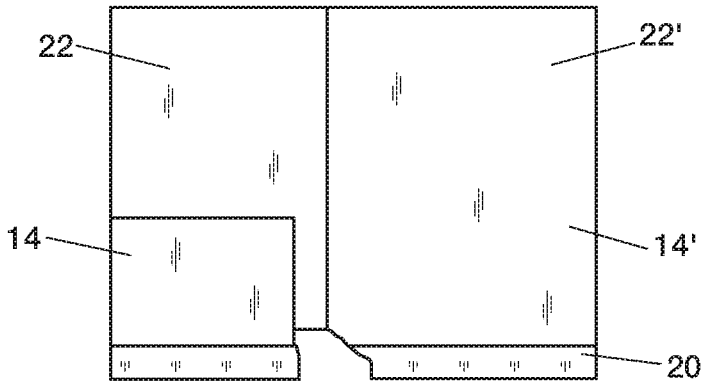
FIG. 4 is a front elevational view of a wall assembly with a lower edge finish.

The invention may also be considered a method for installing drywall. In one embodiment, the method comprises installing a stud wall including studs 24 and a plate 26, fastening a channel 12 formed from a first sidewall 14 and a second sidewall 16 to the stud wall, and inserting a drywall sheet 22 within the channel 12. The second sidewall 16 may be positioned to abut the stud wall and be fastened to it. The method may further include the step of applying mud and painting the drywall sheet 22' and first sidewall 14 to create a uniform appearance, as seen in the right side of FIG. 4. An unpainted drywall sheet 22 and first sidewall 14' are shown on the left side of FIG. 4 for comparison.

The lower edge finish 10 can be made in various lengths, such as 8, 20 or 12 feet in length, or suitable metric lengths. Lengths that are on the order of the length of standard drywall sheets may be used, or other lengths can be used. If a piece of the lower edge finish 10 is too long for a stud wall on which mounting is desired, the piece can be cut to size.

Figure 5:
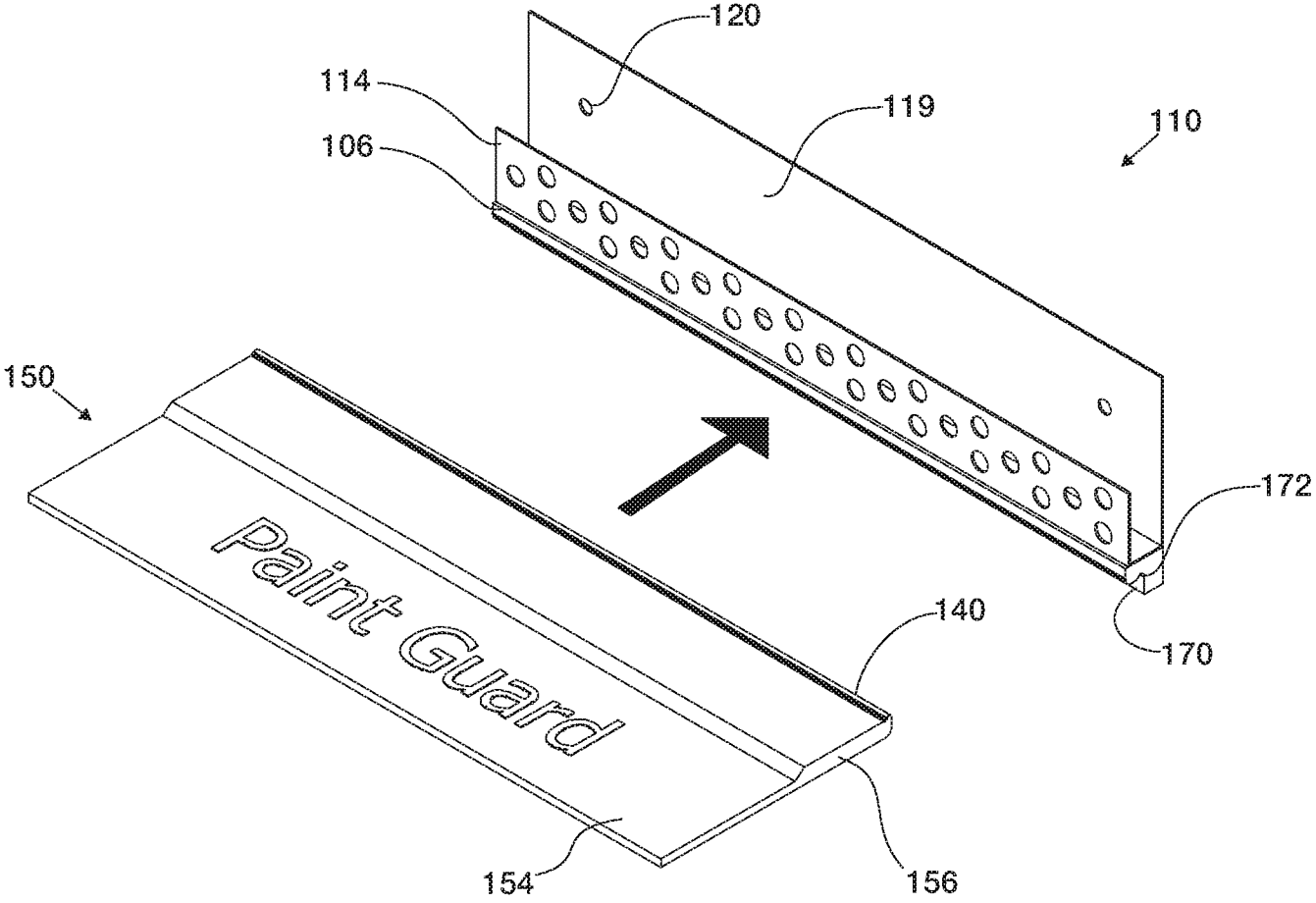
FIG. 5 is perspective view of lower edge finish and paint guard that can be considered as elements of a kit or separate sku's.

FIG. 5 shows another embodiment of the lower edge finish 110. The lower edge finish 110 includes a base 170, which can be an extruded plastic or other material. The bottom of the base 170 has a recess with a furrow 172 upward toward the channel between the front wall 114 and the back wall 119, which are in substantially parallel planes, spaced apart to snugly receive a sheet of drywall. The front wall 114 is provided slightly offset from the front of the base 170 so as to form a front lip 106. The front wall 114 is a preferably a perforated metal sheet. Back wall 119 has holes 120 to receive nails to mount the lower edge finish 110 to the base of a stud wall.

Figure 6:
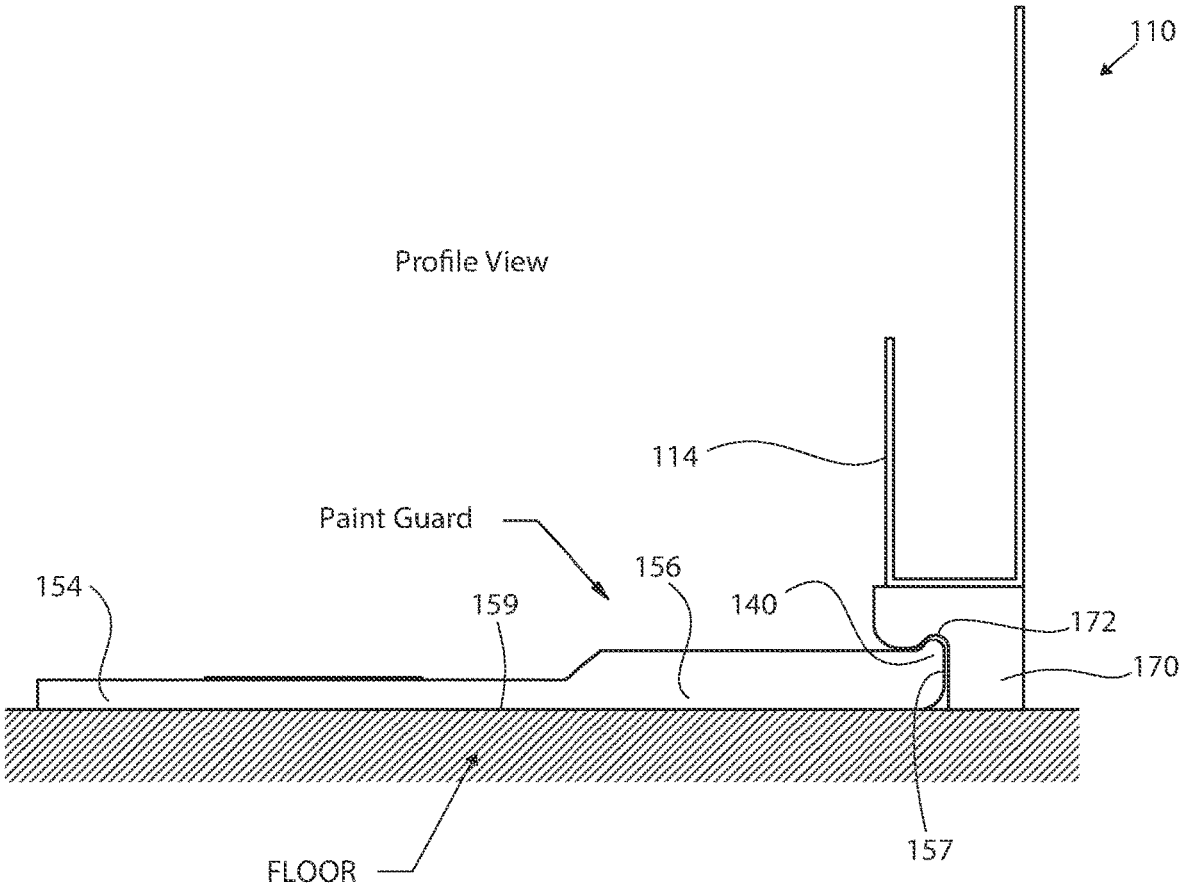
FIG. 6 is a side view of the lower edge finish and paint guard used together.

FIG. 5 shows a paint guard 150 made up of a sheet 154 and edge 156 having a lip 140. As seen, the sheet is coplanar with the bottom of the edge 156. Various materials can be used for the paint guard 150, but the sheet and edge are typically impervious to paint. As seen in FIG. 6, the lip 140 and the furrow 172 in the recess in the base 170 are made with a curved shape. The lip and furrow shapes may be curved as shown and are preferably complementary, so that when the lip 140 is pressed under furrow 172 in the installed base 170, the lip 140 can snap and be retained within the furrow above the floor to hold the edge 156 of the paint guard in place under the front of the base 170. The lip and furrow can have any desired profile shape (not necessarily curved), so long as they can cooperate so the lip is retained in the furrow and can be pulled away without damage when desired. FIG. 6 shows an embodiment in which the edge 156 of the paint guard has a backwall 157 that gradually transitions to a bottom face 159.

The paint guard can be used to catch mud or spackling or other material that is commonly used for finishing the drywall to a smooth wall finish that may otherwise drip onto the floor, so the paint guard 150 protects the floor. The paint guard 150 can be in place as the wall is being painted to catch any paint drips that may occur.

Figure 7:
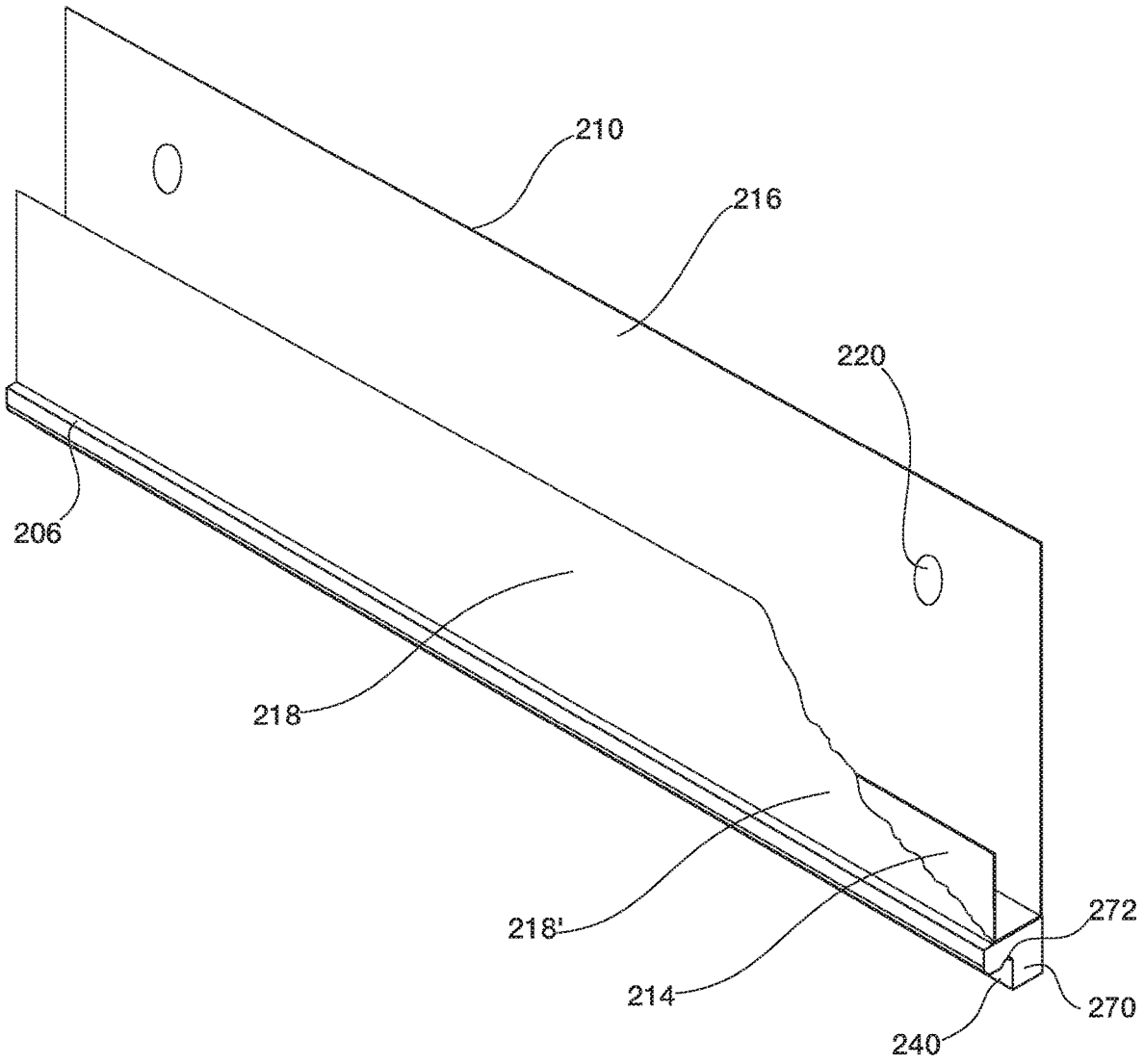
FIG. 7 is perspective view of a lower edge finish having an added paper to serve as a mud application aid.
Figure 8:
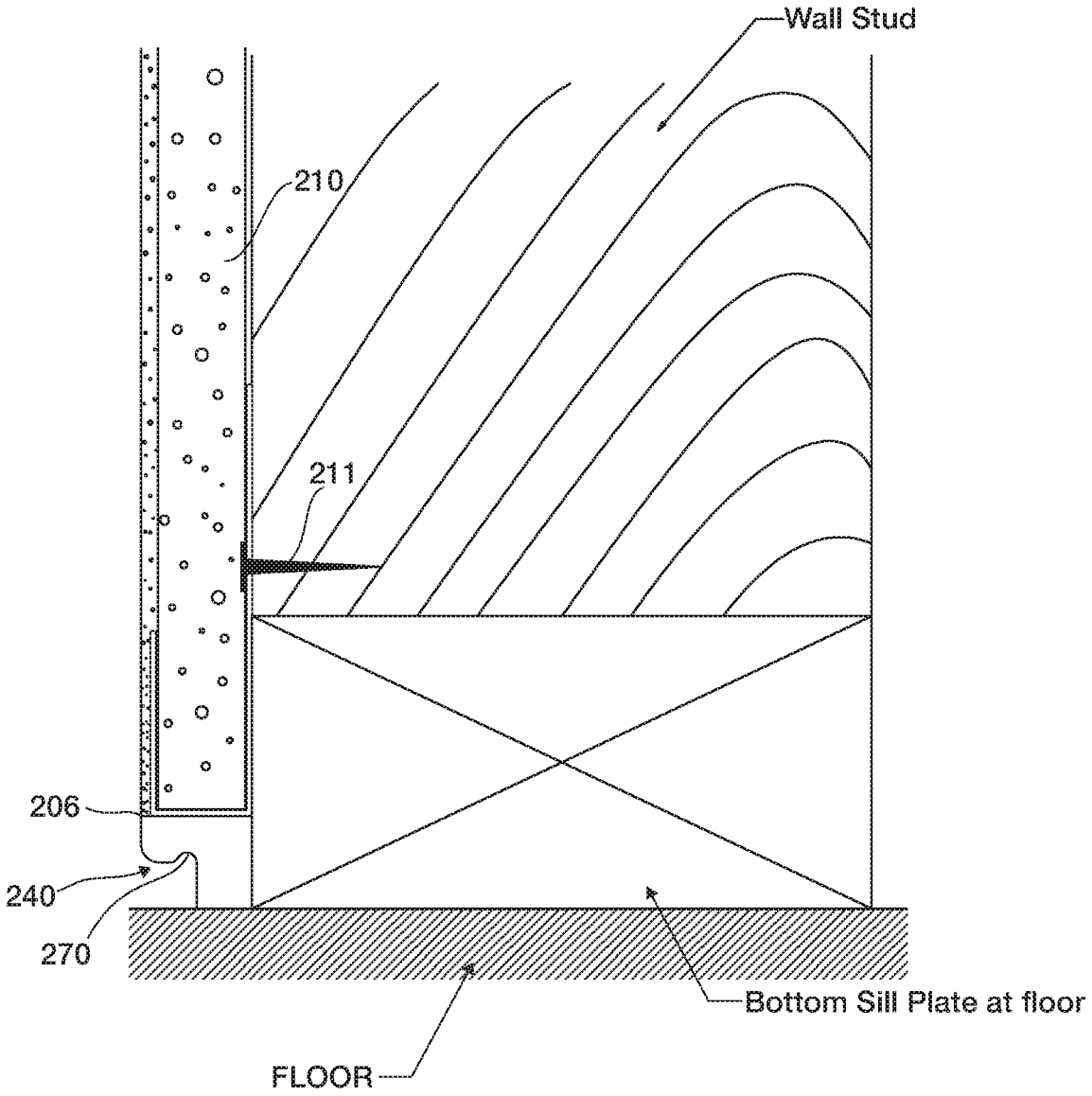
FIG. 8 is a side view of the lower edge finish having an added paper as mounted to a stud wall, with a drywall panel and finished mud.

FIGS. 7 and 8 show further potential elaborations of the lower edge finish. In FIG. 7 the lower edge finish 210 has a backwall 216 with nail holes 220. This figure shows the base 270 with its recess 240 and furrow 272. The front wall 214 extends upward from the base slightly inward from the front of the base, thereby forming a lip 206. The front wall 214 is covered with a sheet of drywall paper 218, which may be glued to the front wall 214 at 218'. The front wall 214 and paper are mounted to the base slightly away from the edge of the base leaving a lip 206. As seen in FIG. 8 when the mud is applied to the drywall, the mud can cover the paper 218 and the drywall, forming a smooth surface down to and with the lip 206. Having the pre-installed paper 218 on the lower edge finish 210 establishes a ready-made "tape" section so mud can be applied directly on the drywall without adding additional tape to secure a seam. The lip 106 of the embodiment shown in FIG. 5 serves a similar purpose to lip 206.

FIG. 8 also shows a nail 211 that has been passed through one of the holes 220.

When the paint is dry, the paint guard can be removed, leaving the recess in the base exposed, so it can serve as a shadow line for a floating wall appearance, or be used to contain carpet edging or other flooring.

The lower edge finish can be offered as a kit or sold separately.

Certain modifications and improvements will occur to those skilled in the art upon reading the foregoing description. By way of example, the sidewalls may be comprised of a rigid type of extruded paper. It should be understood that all such modifications and improvements have been omitted for the sake of conciseness and readability but are properly within the scope of the following claims.

What is claimed is:

1. A lower edge finish for a drywall comprising:

a channel formed from a first sidewall defining a front plane and a second sidewall defining a back plane that is parallel to the front plane, the channel sized to receive a drywall sheet, and a base underneath the channel for supporting a drywall sheet above a floor, the base having a recess below the channel that extends from the front plane toward the back plane and that has a furrow upward toward the channel between the front and back planes, and a paint guard having a sheet and an edge, the edge having a lip that is of a shape that cooperates with the furrow so the lip can be passed into the recess and the lip becomes lodged in the furrow to retain the edge of the paint guard, and the lower edge finish is configured to be applied to a stud wall so that the sheet extends away from the stud wall to protect the floor from drippings from the drywall sheet.

2. The lower edge finish of claim 1, wherein the first sidewall is perforated metal.

3. The lower edge finish of claim 2, wherein the base has a front and the first sidewall extends upward from the base slightly recessed from the front of the base.

4. The lower edge finish of claim 1, wherein a paper sheet extends upward from the base to at least partially cover the first sidewall.

5. The lower edge finish of claim 1, wherein the first sidewall is perforated metal, the base has a front, the first sidewall extends upward from the base slightly recessed from the front of the base, and a paper sheet extends upward from the front of the base to at least partially cover the first sidewall.

6. The lower edge finish of claim 1, wherein the lip and the furrow have complementary curved shapes.

7. The lower edge finish of claim 1, wherein the base is continuous along a length of the channel.

8. The lower edge finish of claim 1, wherein the edge of the paint guard is thicker than the sheet of the paint guard.

9. The lower edge finish of claim 1, wherein the base is comprised of extruded plastic.

10. The lower edge finish as claimed in claim 1 wherein the sheet and the edge are impervious to paint.

11. The lower edge finish for a drywall as claimed in claim 10 wherein the edge of the paint guard has a backwall that gradually transitions to a bottom face.

12. The lower edge finish for a drywall as claimed in claim 1 wherein the edge of the paint guard has a backwall that gradually transitions to a bottom face.

13. A lower edge finish for a drywall comprising:

a channel formed from a first sidewall of perforated metal defining a front plane and a second sidewall defining a back plane that is parallel to the front plane, the channel sized to receive a drywall sheet, a base underneath the channel for supporting the drywall sheet above a floor, the base having a front with the first sidewall extending upward from the base slightly recessed from the front of the base, a paper sheet extending upward from the base to at least partially cover the first sidewall, the base having a recess below the channel that extends from the front plane toward the back plane and that has a curved furrow upward toward the channel between the front and back planes, and a paint guard having a sheet and an edge that is thicker than the sheet, the edge having a curved lip that is of a shape complementary to the furrow, so the lip can be passed into the recess and the lip becomes lodged in the furrow to retain the edge between the floor and the base, and the lower edge finish is configured to be applied to a stud wall so that the sheet extends away from the stud wall to protect the floor from drippings from the drywall sheet.

14. A lower edge finish for a drywall that can cooperate with a paint guard comprising:

a channel formed from a first sidewall defining a front plane and a second sidewall defining a back plane that is parallel to the front plane, the channel sized to receive a drywall sheet, and a base underneath the channel for supporting a drywall sheet above a floor, the base having a bottom that has a recess below the channel that extends from the front plane toward the back plane and that has a furrow upward toward the channel between the front and back planes, the furrow having a shape to cooperate with a paint guard edge.

15. A method of installing drywall comprising:

installing a stud wall onto a floor, fastening a channel with a base that has a drywall paper front to the stud wall at the floor, the base having a recess below the channel and a furrow in the recess upward toward the channel, inserting a lower edge of a drywall sheet into the channel so the drywall paper front partially covers the drywall sheet, applying drywall mud to the drywall sheet and the drywall paper front and the channel to form a smooth wall surface, including covering the drywall paper front with drywall mud.

16. The method of claim 15, including installing a paint guard to the base to protect the floor from drippings from the drywall sheet.

17. The method of claim 15, wherein installing the paint guard includes inserting an edge of the paint guard into the recess in the base.

18. A method of installing drywall comprising:

installing a stud wall onto a floor, fastening a channel that has a base to the stud wall at the floor, the base having a bottom that has a recess below the channel and that has a furrow upward toward the channel, inserting a lower edge of a drywall sheet into the channel so the drywall paper front partially covers the drywall sheet, and installing a paint guard to the base to protect the floor from drippings from the drywall sheet by inserting an edge of the paint guard into the recess in the base to retain the edge at the base.

* * * * *